United States Patent [19]

Groenendaal, Jr.

[11] Patent Number: 4,900,223

[45] Date of Patent: Feb. 13, 1990

[54] STEAM TURBINE

[75] Inventor: John C. Groenendaal, Jr., Winter Springs, Fla.

[73] Assignee: Westinghouse Electric Corp, Pittsburgh, Pa.

[21] Appl. No.: 312,282

[22] Filed: Feb. 21, 1989

[51] Int. Cl.[4] ..... F01D 9/04; F01D 3/02

[52] U.S. Cl. ..... 415/190; 415/103; 415/194; 415/199.5; 415/206; 415/208.1

[58] Field of Search ..... 415/189, 190, 207, 208.1, 415/211.2, 214.1, 191, 196, 206, 101, 103

[56] References Cited

U.S. PATENT DOCUMENTS

| | | | |
|---|---|---|---|
| 2,980,396 | 4/1961 | Mousesian | 415/189 |
| 3,817,655 | 6/1974 | Huesgen et al. | 415/189 |
| 3,945,760 | 3/1976 | Miller | 415/189 |
| 4,232,993 | 11/1980 | Ikeda et al. | 415/103 |

*Primary Examiner*—Robert E. Garrett
*Assistant Examiner*—Hoane M. Nguyen
*Attorney, Agent, or Firm*—K. Bach

[57] ABSTRACT

A steam turbine has an outer blade ring supporting a row of stationary blades and an adjacent downstream row of long rotatable blades. The outer blade ring has a generally conical flow-guiding surface for outwardly guiding the steam as it flows through the row of stationary blades. The outer blade ring is supported by a radially juxtaposed carrier ring having a flow-guiding surface axially adjacent to and extending outwardly from the flow-guiding surface of the outer blade ring. A spacer ring is axially adjacent to the carrier ring and has a flow-guiding surface adjacent to and extending outwardly from the flow-guiding surface of the carrier ring. An exhaust flowguide is axially adjacent the spacer ring and radially adjacent the row of rotatable blades for guiding the steam from the rotatable blades.

11 Claims, 3 Drawing Sheets

STEAM TURBINE

BACKGROUND OF THE INVENTION

This invention relates to steam turbines. More particularly, it relates to low pressure steam turbines wherein steam generally flows axially through rows of radially extending stationary blades supported by outer blade rings and rotatable blades mounted on a rotor to an exhaust guideway directing the steam from the last row of blades toward an exhaust.

Generally speaking, the power output of a steam turbine is a function of several known variables importantly including the steam flow rate. Thus, it has been proposed to increase the steam flow rate and thereby enhance the power output of existing low pressure turbines by replacing the rotatable blades in the last row of the turbines with longer blades. A significant increase in steam flow rate would be realized by replacing the original rotatable blades with rotatable blades which radially extend beyond the stationary blade assembly. However, this would require that steam flow-guiding surfaces of the outerblade ring supporting the stationary blades be extensively machined to provide a more outwardly directed flow-guiding surface for guiding the steam to the tips of the replacement rotatable blades. Extensive machining of the outer blade ring of an existing turbine and a carrier ring which conventionally supports the outer blade ring will remove the juxtaposed downstream ends of the outer blade ring and the carrier ring which conventionally provides bearing support to secure the stationary blades and the outer blade ring against axially directed pressures on the blades. In addition, an exhaust flowguide conventionally bolted to the carrier ring of an existing turbine cannot be realigned with the carrier ring if the replacement rotatable blades radially extend beyond the outer blade ring supporting the stationary blades.

It is an object of the invention to provide a steam turbine with flow-guiding surfaces guiding steam to and from a row of rotatable blades which extend radially beyond outer blade ring supporting the axially adjacent upstream row of stationary blades.

It is a further object of the invention to provide support for the gas flow-guiding surfaces in flow communication with relatively long rotatable blades.

SUMMARY OF THE INVENTION

With these objectives in view the present invention resides in a steam flow turbine in which steam axially flows in a casing through a row of stationary blades supported by an outer blade ring and an axially adjacent downstream row of rotatable blades and then into an exhaust flowguide wherein the tips of the rotatable blades radially extend beyond the outer blade ring supporting the stationary blades in the adjacent upstream row. The outer blade ring has a generally conical flow-guiding surface for outwardly guiding the steam toward the tips of the downstream rotatable blades. A carrier ring fixedly mounted in the casing is radially juxtaposed with the outer blade ring for supporting the stationary blades. The carrier ring has a flow-guiding surface axially adjacent to and extending outwardly from the outer blade ring flow-guiding surface. A spacer ring is axially adjacent the carrier ring, and has a flow-guiding surface adjacent to and extending outwardly from the flow-guiding surface of the carrier ring. An exhaust flowguide is axially adjacent the spacer ring for guiding the steam through the row of rotatable blades and toward an exhaust chamber.

In a preferred embodiment of the steam turbine, the carrier ring supporting the outer blade ring has a groove for receiving a tongue extending from the outer blade ring for securing the stationary blades in the carrier ring. The groove is axially spaced from the gas flow-guiding surface of the carrier ring. The spacer ring preferably has an undercut portion for fitting over the carrier ring to assure concentricity. Also, the exhaust flowguide and spacer ring are fastened to a wall supporting the carrier ring for also supporting the carrier ring as well as the exhaust flowguide and the spacer ring.

The invention is particularly useful for upgrading existing turbines to accommodate greater steam flow than the flow for which the turbine was originally designed.

DESCRIPTION OF THE DRAWINGS

The invention will become more readily apparent from the following description of a preferred embodiment thereof shown, by way of example only, in the accompanying drawings, wherein.

DETAILED DESCRIPTION

Figures 1, 2:
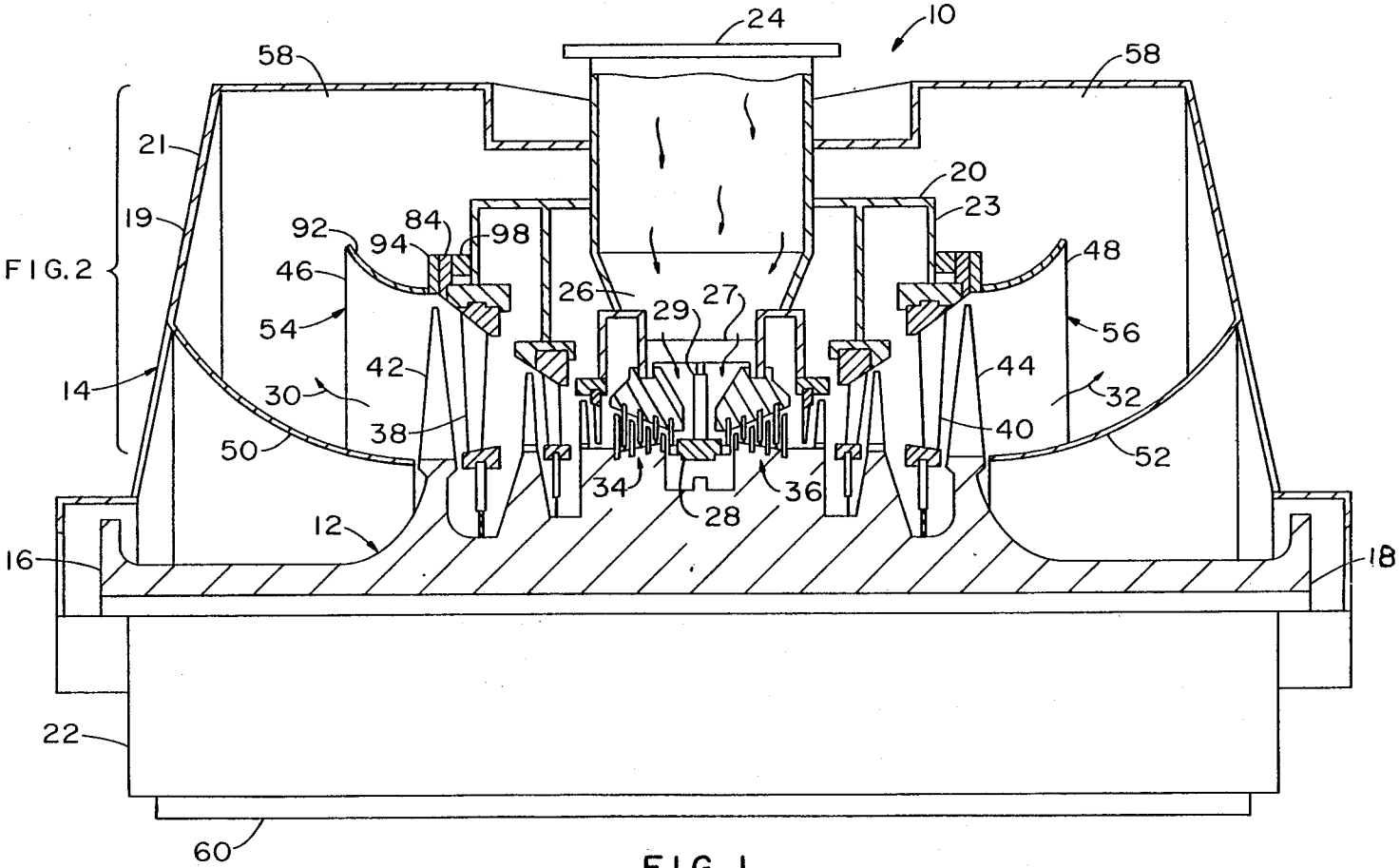
FIG. 1 is a partial sectional longitudinal view of an axial flow steam turbine employing the present invention.
FIG. 2 is an enlarged longitudinal view of the last row of stationary blades and rotatable blades and the downstream exhaust flowguide generally indicated by bracket 2 in FIG. 1.
Figure 2:
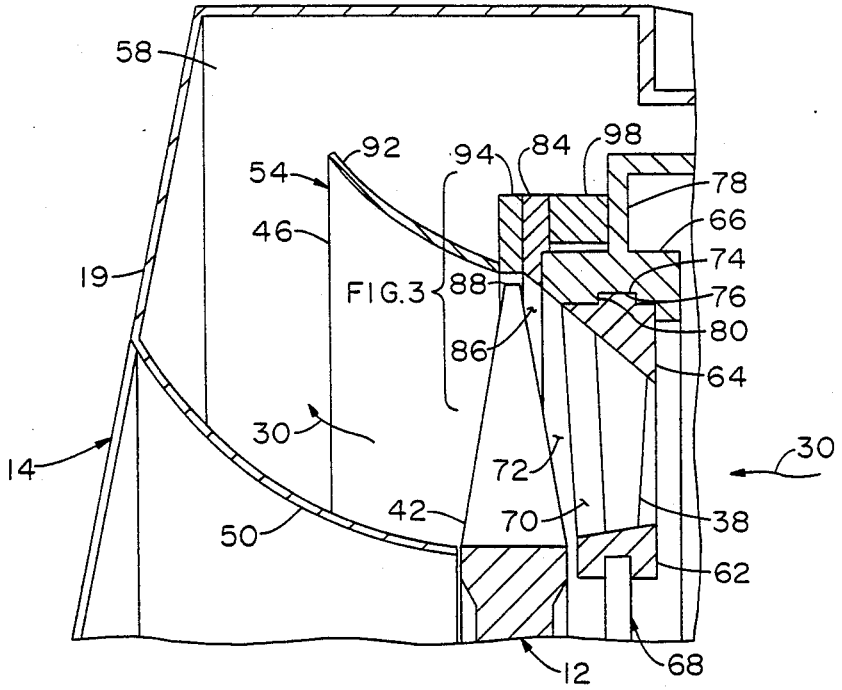
Figure 3:
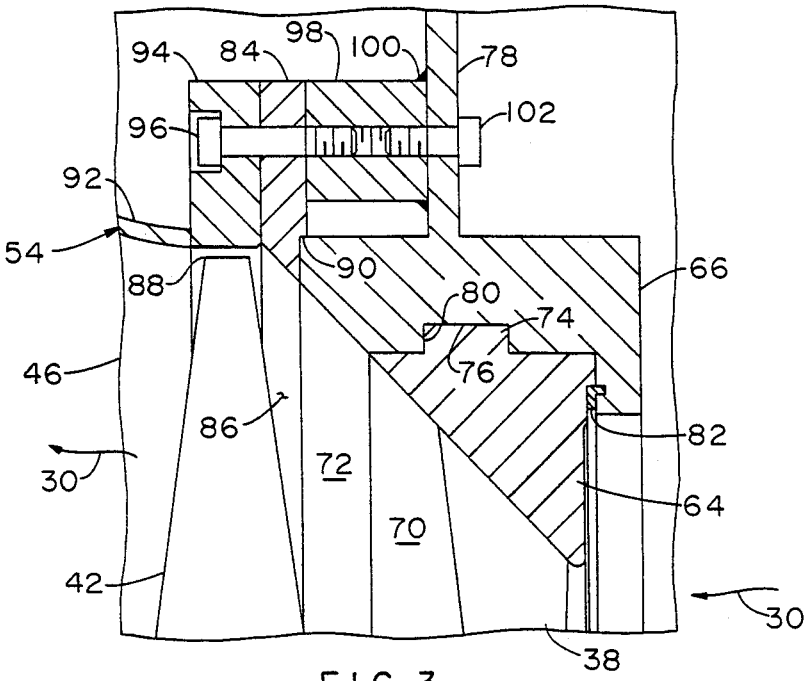
FIG. 3 is an enlarged longitudinal view generally showing the radial ends of the turbine blades and exhaust flowguide generally indicated by bracket 3 in FIG. 2.

FIG. 1 generally shows a multistage double flow low pressure steam turbine embodying the present invention. The turbine 10 generally has a rotor structure 12 axially extending in a casing 14 between two ends 16, 18. Conventionally, a generator (not shown) or other low pressure steam turbine is operatively coupled with one end of the rotor structure 12 and a high pressure or another low pressure steam turbine (not shown) is operatively coupled with the other end of the rotor structure 12. The casing 14 generally comprises an outer casing 19 and an inner casing 20. The outer casing 19 is horizontally split into a top half 21 and a bottom half 22. The inner casing 20 is similarly split into a top half 23 and a bottom half (not shown).

The steam flows into the turbine 10 through spaced inlet connection such as inlet connection 24 to a centrally disposed inlet chamber 26 generally surrounding the rotor structure 12. The steam flows inwardly around spaced thrust-absorbing stay bars 27 and impinges upon inlet flowguides 28 supported via arms 29 by the stay bars 27. The inlet flowguides 28 protect the rotor structure from the high velocity steam and guide the steam axially. The steam then divides into two streams 30,32; one 30 of which flows along a generally axial path through several turbine blade stages 34 toward the one end 16 of the rotor structure 12 and the other stream 32 flows along a generally axial path through an identical number of turbine blade stages 36 toward the other end 18 of the rotor structure 12. In the turbine 10 shown, the steam streams 30,32 flow through seven stages of blades radially extending in the steam flow path. Each blade stage generally comprises an upstream row of stationary blades fixedly mounted in the casing 14 and a downstream row of rotatable blades mounted on the rotor structure. The steam 30,32 generally flows from the last row of stationary blades represented by stationary blades 38,40 and the last row of rotatable blades represented by rotatable blades 42,44; through an annular exhaust guideway 46,48 defined by inner housings 50,52 and exhaust flow guides 54,56; and into an exhaust chamber 58. The steam then flows through a large downwardly facing exhaust connection 60 in the bottom half 22 of the outer casing 19 and into a condenser (not shown).

FIGS. 2–5 generally show the last row of turbine blades 38,42 and the downstream exhaust guideway 46 near the one end 16 of the rotor structure 12. The structural arrangement of the last row of turbine blades 40,44 and the downstream exhaust guideway 48 near the other end 18 of the rotor structure 12 is identical and need not be further discussed.

The stationary blades 38 extend radially from the rotor structure 12 between an inner blade ring 62 and a concentric outer blade ring 64. The stationary blades 38 are welded to the rings 62,64 to form a stationary blade assembly which is generally supported by a carrier ring 66. The carrier ring 66 is integrally cast or weld fabricated with the casing 14 and therefore is formed by two half rings, one of which is integral with the top half 23 of the inner casing 20 and the other is integral with the bottom half of the inner casing 20. The inner blade ring 62 supports a seal arrangement 68 such as the low diameter seal shown.

The outer blade ring 64 has a conical flow-guiding surface 70 for outwardly guiding the steam 30 flowing through the stationary blades 38 toward the rotatable blades 42. The carrier ring 66 has a flow-guiding surface 72 axially adjacent to and extending outwardly of the outer blade ring flow-guiding surface 70 for guiding the steam 30 as it flows from the stationary blades 38 toward the rotatable blades 42. The outer blade ring 64 is secured in the carrier ring 66 by a tongue and groove fit which is spaced from the flow-guiding surfaces 70,72. As shown, the outer blade ring 64 has a tongue 74 which fits into a groove 76 in the carrier ring 66 and the tongue 74 and groove 76 axially extend upstream and downstream of a radially extending casing wall 78 supporting the carrier ring 66. The downstream wall 80 of the carrier ring groove 76 is a bearing surface which reacts to the axially directed pressures exerted on the stationary blades 38 by the steam 30. Alternately the tongue-and-groove fit may comprise a carrier ring tongue (not shown) extending radially into an outer blade ring groove (not shown), and the bearing wall in this alternative arrangement would be the upstream wall of the carrier ring tongue. The outer blade ring 64 is axially urged against the carrier ring groove wall 80 by a caulking metal (FIG. 3) 82 which is plastically deformed during the assembly process when the metal 82 is driven into a cavity defined by the outer blade ring 64 and the carrier ring 66.

A spacer ring 84 axially adjacent the carrier ring 66 has a steam flow-guiding surface 86 extending outwardly from the flow-guiding surface 72 of the carrier ring 66 for guiding the steam toward the tips 88 of the rotatable blades 42. The spacer ring 84 has an undercut portion 90 for fitting over the outer circumferential surface of the carrier ring 66 for .aligning the gas flow-guiding surface 72 of the carrier ring 66 and the gas flow-guiding surface 86 of the spacer ring 84. Alternatively, the spacer ring 84 and the carrier ring 66 may be aligned by an axially extending tongue-and-groove fit (not shown).

The rotatable blades 42 are mounted on the rotor structure 12 downstream of the stationary blades 38. As is shown in the drawings, the tips 88 of the blades 42 radially extend beyond the outer blade ring 64 supporting the stationary blades 38. Also, the steam flow-guiding surfaces 70,72 and 86 of the outer blade ring 64, carrier ring 66 and spacer ring 84, respectively, guide the steam 30 across the entire length of the rotatable blades 42.

The exhaust flowguide 54 has a generally conical housing 92 extending from a flange 94 disposed around the row of rotatable blades 42 with the flange 94 axially adjacent the spacer ring 84 for axially directing the steam 30 away from the row of blades 42. As may be most clearly seen in FIG. 3, the exhaust flow guide flange 94, and spacer ring 84 are fastened by bolts 96 to bosses, such as boss 98, which are welded to the radial casing wall 78. Preferably fillet welds 100 are employed so that long weld beads do not present a threat of thermal distortion. The bosses 98 are preferably redundantly fastened to the radial casing wall 64 with bolts, such as bolt 102 to secure the bosses 98 in the event that the welds 100 fail because of fatigue, corrosion, stress corrosion or other causes. The undercut 90 of the spacer ring 84 provides a convenient means for locating the exhaust flowguide flange 94 and redundantly supporting the carrier ring 66 against the pressure of the steam flow.

Figure 4:
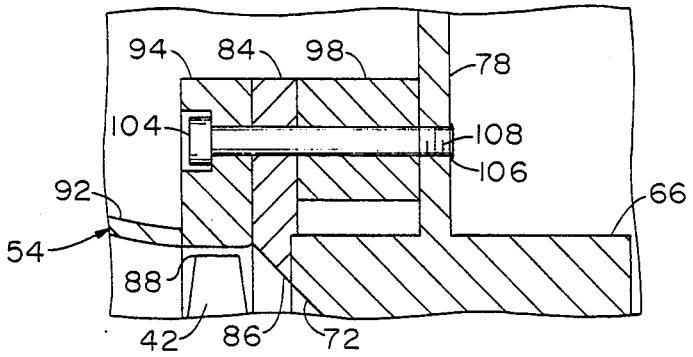
FIG. 4 is a longitudinal view generally showing an alternative means for supporting the structure shown in FIG. 3.

FIG. 4 shows an alternative means for fastening the flange 94, spacer ring 84 and bosses 98 to the radial casing wall 78 wherein a relatively long bolt 104 extending from the flange 94 threadably engages the radial casing wall 78 as shown. A continuous, locking weld 106 is preferably provided for locking the threaded engagement in the event that the threads 108 do not remain tight and for protecting the threads 108 from corrosion. In addition less welding is required by the structure shown in FIG. 4 as compared with the structure shown in FIG. 3.

Figure 5:
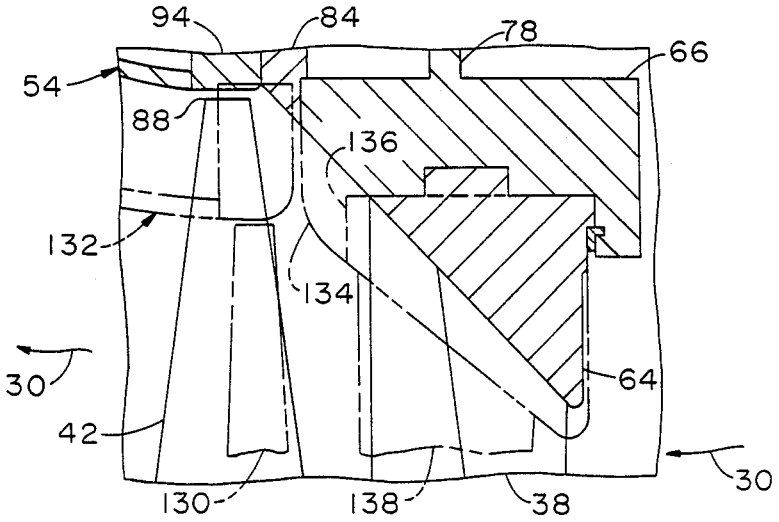
FIG. 5 is a longitudinal view of the principal structure of the turbine shown in FIG. 3 which also shows in phantom the relative position of blades of a conventional turbine.

This invention is particularly useful for retrofitting existing turbines in order to enhance their power output. FIG. 5 generally compares the retrofitted turbine 10 of FIGS. 1–3 with its original design, which is shown in phantom. As discussed above, the retrofitted turbine 10 generally has a row of stationary blades such as blade 38 mounted within a carrier ring 66 and an adjacent downstream row of relatively long rotatable blades such as blade 44 within an exhaust flowguide 54. Originally the turbine 10 employed shorter rotatable blades such as blade 130 disposed within a smaller exhaust flowguide 132 which was bolted directly to the adjacent downstream end 134 of the carrier ring 66 rather than to more distant radial casing wall 78 for supporting the exhaust flowguide 132. The adjacent downstream end 134 of the carrier ring 66 also originally provided a bearing wall 136 for securing the original stationary blades 138 in place. As can be seen in FIG. 5, the downstream end 134 of the carrier ring 66 and its original bearing wall 136 had to be machined from the carrier ring 66 in order to provide a properly oriented steam flow-guiding surface 72 upstream of the rotatable blades 42. Thus the original stationary blade assembly would have not been securely mounted in the carrier ring 66.

While a presently preferred embodiment of the invention has been shown and described it is to be distinctly understood that the invention is not limited thereto but may be otherwise variously embodied with the scope of the following claims.

What is claimed is:

1. A steam turbine wherein steam axially flows along a path through stationary blades and rotatable blades radially extending in the steam flow path and then through an exhaust guideway, the steam turbine having:

a casing;

an outer blade ring supporting a row of radially extending stationary blades, the outer blade ring having a generally conical flow-guiding surface for outwardly guiding the steam as it flows through the row of stationary blades;

a carrier ring fixedly mounted in the casing and radially juxtaposed around the outer blade ring for supporting the outer blade ring, the carrier ring having a flow-guiding surface axially adjacent to and extending outwardly from the flow-guiding surface of the outer blade ring;

a spacer ring axially adjacent to the carrier ring, the spacer ring having a flow-guiding surface adjacent to and extending outwardly from the flow-guiding surface of the carrier ring;

a row of rotatable blades, each rotatable blade having a tip adjacent the spacer ring flow-guiding surface, the tips radially extending beyond the outer blade ring; and an exhaust flowguide axially adjacent the spacer ring.

2. The steam turbine of claim 1, wherein the outer blade ring is secured in the carrier ring by a tongue-and-groove fit.

3. The steam turbine of claim 2, wherein the outer blade ring has a tongue which fits into a groove in the carrier ring.

4. The steam turbine of claim 3, wherein the carrier ring is integrally formed with a radially extending casing wall and wherein the tongue of the outer blade ring axially bears against the carrier ring downstream of the radially extending casing wall.

5. The steam turbine of claim 1, wherein the spacer ring has an undercut portion adapted to fit over the carrier ring for aligning their flow-guiding surfaces.

6. The steam turbine of claim 1, wherein the carrier ring is integrally formed with a radially extending casing wall and the exhaust flowguide has a flange axially adjacent the spacer ring and radially adjacent the rotatable blades, and wherein bosses are disposed radially of the carrier ring between the spacer ring and the radially extending casing wall and the flange of the exhaust flowguide is fastened to the radially extending casing wall through the spacer ring and the bosses for supporting the exhaust flowguide and the carrier ring.

7. The steam turbine of claim 6, wherein the flange and the spacer ring are fastened to the bosses by bolts which threadably engage the bosses and the bosses are fastened to the radially extending casing wall by fillet welds.

8. The steam turbine of claim 7, wherein the welded bosses are also fastened to the radially extending casing wall by bolts which threadably engage the bosses.

9. The steam turbine of claim 6, wherein the flange is fastened to the radially extending casing wall with bolts extending from the flange to threadably engage the wall.

10. The steam turbine of claim 9, wherein the bolts are welded to the radially extending casing wall.

11. A steam turbine wherein steam axially flows along a path through stationary blades and rotatable blades and then through an exhaust guideway, the steam turbine having:

a casing;

an outer blade ring supporting a row of radially extending stationary blades, the outer blade ring having a generally conical flow-guiding surface for outwardly guiding the steam as it flows through the row of stationary blades toward an exhaust guideway;

a carrier ring integrally formed with a radially extending wall of the casing and radially juxtaposed around the outer blade ring, the outer blade ring being supported by the carrier ring through a tongue-and-groove fit, the carrier ring having a flow-guiding surface axially adjacent to and extending outwardly from the flow-guiding surface of the outer blade ring;

a spacer ring axially adjacent to the carrier ring, the spacer ring having a flow-guiding surface adjacent to and extending outwardly from the flow-guiding surface of the carrier ring, and having an undercut portion adapted to fit over the carrier ring for aligning their flow-guiding surfaces;

a row of rotatable blades, each rotatable blade having a tip adjacent to the spacer ring flow-guiding surface, the tips radially extending beyond the outer blade ring; and an exhaust flowguide axially adjacent the spacer ring, the exhaust flowguide having a flange fastened to the spacer ring and the radially extending casing wall integrally formed with the carrier ring.

* * * * *